US007008259B2

(12) United States Patent
Agnew

(10) Patent No.: US 7,008,259 B2
(45) Date of Patent: Mar. 7, 2006

(54) HEAVY DUTY, HIGH EFFICIENCY JUMPER CABLES

(76) Inventor: James H. Agnew, 1608 Highway 86, Piedmont, SC (US) 29673

( * ) Notice: Subject to any disclaimer, the term of this patent is extended or adjusted under 35 U.S.C. 154(b) by 0 days.

(21) Appl. No.: 10/993,736

(22) Filed: Nov. 19, 2004

(65) Prior Publication Data

US 2005/0124229 A1 Jun. 9, 2005

Related U.S. Application Data

(60) Provisional application No. 60/528,023, filed on Dec. 9, 2003.

(51) Int. Cl.
*H01R 4/48* (2006.01)

(52) U.S. Cl. ..... 439/504; 439/759; 439/829

(58) Field of Classification Search ..... 439/504, 439/759, 829, 828, 754
See application file for complete search history.

(56) References Cited

U.S. PATENT DOCUMENTS 4,153,321 A 5/1979 Pombrol
4,565,414 A * 1/1986 French ..... 439/241
4,620,767 A * 11/1986 Woolf ..... 439/217
4,662,696 A 5/1987 Asbury
4,721,479 A 1/1988 Shuman
4,826,457 A * 5/1989 Varatta ..... 439/755
5,002,508 A * 3/1991 Craveiro ..... 439/755
5,167,529 A * 12/1992 Verge ..... 439/504
5,316,498 A 5/1994 Hooper
5,984,718 A * 11/1999 James ..... 439/504
6,623,314 B1 * 9/2003 Cox et al. ..... 439/759

* cited by examiner

*Primary Examiner*—Gary Paumen
(74) *Attorney, Agent, or Firm*—Stephen R. Chapman

(57) ABSTRACT

A heavy duty, high efficiency jumper cable system designed to deliver 250 to 3,800 amps with minimal loss by transmitting current from a source through a cable/terminal connector through a heavy duty cable to a second cable/terminal connector and then to a discharge point. The cable/terminal connectors include an electrical harness that minimizes power loss by direct contact between the cable delivering current to the cable connector and a pair of electric contacts, each member of which is positioned in an end of a support. The system is uniquely, but not specifically adapted for use with electrical systems associated with diesel powered vehicles and equipment.

4 Claims, 8 Drawing Sheets

HEAVY DUTY, HIGH EFFICIENCY JUMPER CABLES

RELATION TO PRIOR APPLICATION

This application claims priority of U.S. Provisional Application No. 60/528,023 filed Dec. 9, 2003.

FIELD OF THE INVENTION

This invention pertains to equipment adapted to transmit electrical current over relatively short distances, most commonly between a relatively fully charged battery to a discharged battery that provides electrical power to operate a device, such as a starter motor associated with a larger piece of machinery, such as an automobile, truck, or gasoline or diesel powered engine used to drive heavy equipment. More specifically, the invention is directed to a system of jumper cables commonly used to start vehicles with discharged or weak batteries, and even more specifically it is directed to a jumper cable system capable of delivering DC electrical energy in a range of from 3 to 48 or more volts, preferably 6 to 24 volts at 250 to 3,800 amps for periods of 30 seconds to six more minutes without significant loss of electrical energy from the source to the point of delivery and without excessive, potentially damaging heating to the jumper cables or to the equipment being serviced and with minimum danger of an explosion caused by a spark from connecting the cables to the batteries.

BACKGROUND OF THE INVENTION

The common set of jumper cables comprises two cables with clamp-like devices electrically connected to each end of each cable. In use, the clamp-like devices of one cable are attached to the positive terminal or pole of a charged batter (source point), and the clamp-like device of the same cable is attached to the positive pole or terminal of a discharged battery (delivery point). In a similar manner, one clamp-like device attached to one end of the second cable is attached to the negative pole or terminal of the charged battery, and a clamp-like device attached to the opposite end of the second cable is attached to the negative pole of the discharged or dead battery. Electrical energy flows from the charged point to the discharged point.

The common, available sets of jumper cables are designed for use with automobiles and light trucks and vehicles or systems with related power demands. The capacity of the jumper cable systems, cables and clamp-like devices is 6 to 12 volts at generally less than 1,000 amps.

The electrical circuitry is simple. Electrical current is carried from the charged battery, "through" the discharged (dead) battery to for example, a starter motor for an engine. The electrical energy is carried through a pair of cables connected appropriately to the charged battery and to the discharged battery, although as one skilled in the art recognizes, the connection could be directly to the starter motor or other device.

Jumper cable systems are subject to losses in efficiency as a result of design and laws of physics. By way of illustration, consider only one of the two cables comprising the common jumper cable system. Electrical current travels from the terminal of the charged battery to the clamp-like device attached to that terminal and then passes across the clamp-like device to the cable to be transmitted to the clamp-like device at the opposite end of the cable, thence across that clamp-like device to be discharged to the terminal at the point of demand. In effectively all situations, source voltage is fixed and determined by the charged battery. Thus, electrical powered delivered is a function of amps delivered. In a perfect situation, all current delivered by the charged battery to the clamp-like device connecting the jumper cable system to the charged battery would be transmitted to the demand point for use. This is not practically possible.

Electrical current passing through a conductor encounters resistance which ultimately leads to the generation of heat. Obviously, electrical energy used to generate the heat is lost and will not be delivered to the demand point for use. Furthermore, heating increases resistance that in turn further increases heating and energy loss to the demand point. Heating, hence energy loss is a complex function of the duration and rate of the current flow, the amperage, and the resistance of the conductors through which the current is flowing.

Although the delivery cables may be selected to minimize heating and resultant energy loss, existing clamp-like devices represent a significant source of inefficiency as a result of heating. The basic design of the clamp-like device is a pair of jaws. The cable is connected to one member of the pair, but the entire clamp-like device is energized as a result of physical contact between the jaws by means of a pivot point and spring, and as a result of the contact of both members of the pair of jaws with the terminal of either the charged battery or of the discharge battery. Note the inefficiency occurs with clamp-like devices at both the charged and discharged terminals. Frequently for purposes of combinations of strength, weight, costs, and similar devices factors, the conductivity of the clamp-like device is less than the conductivity of the transmission cable to which clamp-like devices are attached. When a jumper cable system is used for relatively brief periods, less than several minutes at moderate current loads of 6 to 12 volts delivered at less than 250 amps, heating and losses of efficiency related to available systems is relatively inconsequential; however, with longer durations and higher amperage loads reflected by higher amperage of current delivered delivered, for example 1800 to 3,800 amps, heating and the associated inefficiencies represent a significant problem.

U.S. Pat. No. 4,153,321 issued May 8, 1979 to Pombrol recognizes the need for a secure contact between the jaws connected to the battery post or terminal and a booster cable. The contact areas of each arm of the connector clamp are brought together and secured by a ratchet-like action between teeth of a flexible member of the connector clamp.

Safety of use is the focal point of U.S. Pat. No. 4,662,696 issued May 5, 1987 to Asbury. Sparks resulting from connecting the jaw-like clamps of jumper cables to battery terminals have triggered battery explosions resulting in significant injuries. The '696 patent claims a switch in the second cable that is open when the cable ends are connected to the battery terminals and closed after the potentially dangerous connection is completed to complete the circuit and allow current to flow. The switch is a spark retarding device positioned in an insulated housing to minimize the occurrence of spark induced battery explosions.

U.S. Pat. No. 4,721,479 issued Jan. 26, 1988 to Shuman claims alternative methods to reduce explosion hazards when jumper cables are connected to batteries. Either only one or both cables of a jumper cable system are severed near their midpoint. If only one cable is severed, the cable is reconnected by an allegator clamp fixed to one severed end gripping the conductor portion of the other severed end, after the cable has been attached to the battery terminals. If both cables are severed, a jack-type plug is used to connect one cable, and the previously described jaw connector is used to join the severed ends of the other cable.

Modifications to the jaw-clamps of a booster cable system are claimed in U.S. Pat. No. 4,862,457 issued May 2, 1989 to Varatta. In the '457 patent, the jaw portion of the cable attachment clamp is positioned at an angle to the handle portion of the clamp to facilitate attachment of the clamp to a battery terminal located on the side, rather than on the accessible top surface of the battery. The improved clamp is also adapted for use on top mounted battery terminals.

Other, less technical considerations have not been ignored in booster cable technology. U.S. Pat. No. 5,316,498 issued May 31, 1994 to Hooper claims a system to securely store a set of booster cables or booster cable system to minimize damage to the system.

Recent years have witnessed a dramatic increase in the number of diesel-powered automobiles, as well as pickup trucks used as personal vehicles, and a profusion of sport utility vehicles. Otherwise, the use of diesel engines in commercial vehicles and for heavy construction and farm equipment remains at least constant.

Batteries serving diesel powered machinery of all types are subject to failure for the same reason they fail in gasoline powered applications. Thus, diesel powered equipment will find use for jumper cable systems just as gasoline systems do. Compared with the batteries commonly used in electrical systems of gasoline powered automobiles and equipment in general, batteries used for electrical systems in diesel equipment, starter motors for an excellent example, require more energy. Jumper cable systems supplying current for diesel electrical systems must be capable of delivering more current, potentially over longer intervals of time periods.

Although the basic jumper cable system has not changed, various improvements have been made. However, current technology does not address the loss of electrical power and the need for more efficient jumper cable systems. Thus there remains room and need for high efficiency, heavy duty jumper cables that can be used with safety and convenience to supply temporary power to electrical systems associated with diesel powered vehicles and equipment and that simultaneously can be used to supply electrical systems common to gasoline powered vehicles and equipment.

SUMMARY OF THE INVENTION

A purpose of the invention is a battery jumper cable system capable of transmitting electrical current in the range of from about 6 volts to about 48 volts at from about 250 amps to about 3,800 amps. A further purpose of the invention is a high efficiency cable connector capable of connecting a cable to a battery and conducting electrical current in the range of from about 6 to 48 volts, preferably from about 12 to 48 volts at from about 250 to 3,800 amps for periods of from about 30 seconds to six minutes or more without overheating and excessive increase of resistance and resultant loss of energy from a source point to a delivery point. Still further, a purpose of the invention is a safety coupler device (spark guard coupling device) to reduce the danger of a battery explosion caused by a spark when the a circuit is completed using the jumper cable system, and a final purpose of the invention is a storage case for a jumper cable system that protects the cable, cable connectors, and cable coupler from damage, serves as a convenient storage receptacle for the jumper cable system and for associated tools and supplies.

These and other purposes are achieved by a heavy duty, high efficiency jumper cable system comprising two cables one of which cables is divided into two segments, and the segments are electrically connected by a spark guard coupler device inserted at approximately the midpoint of the cable, and further wherein an individual cable/terminal connector unit is electrically connected to each of each of the two ends of each of the two cables, and still further by a storage cable case safely storing the cables, safety coupler, and cable connectors and related equipment in a convenient arrangement; further, these and other purposes are achieved by a cable/terminal connector with a frame structure comprised of two frame units that are pivotally connected by a fastener, preferably a rivet that connects the frame units and that also serves as the axle for a spring which provides grasping force for the cable/terminal connector to grasp a battery terminal, and further wherein each frame unit at one end is adapted to receive and hold in position one member of a pair of electrical contact elements, preferably a pair of copper bars that are electrically connected by means of a heavy duty connector cable and held in position by fasteners, such as a nut and bolt, and further wherein one cable of a jumper cable system is connected to a conductor connection means, preferably a lug that by a bolt and nut conducts electricity and that simultaneously connects the conductor connection means with the electrical contact element, connects the cable with the connector cable and holds the electrical contact element in position in the frame unit. One skilled in the art recognizes the conductor contact means includes physical connections including but not limited to welding and soldering.

These and other purposes and advantages of the invention are more fully understood and appreciated by reference to the following figures, descriptions and examples.

DESCRIPTION OF THE PREFERRED EMBODIMENTS

Electrical systems of diesel engines generally require more energy than corresponding systems associated with gasoline powered engines. This is particularly true of the power required to operate the starter motor of a diesel engine compared with a comparable gasoline engine. This is reflected in the requirements of diesel systems for electrical power systems operating in the range of from 6 to 48 volts, preferable about 12 volts delivering from 250 to 3,800 amps, preferably from 1,200 to 1,800 amps. Jumper cable systems designed for effective use with diesel powered vehicles and equipment must be capable of delivering electrical energy within these limits, and systems commonly used with gasoline powered automobiles fail to reach the desired limits, thus cannot be used effectively for even relatively short periods of time.

The heavy duty, high efficiency, jumper cable system of the current invention delivers DC current in the range of from 6 to 48 volts, preferably about 12 volts at from 250 to 3,800 amps for a period of from 30 seconds to six minutes or more without excessive overheating and resulting loss of efficiency in current delivery and damage to the system. The system is designed for demands of electrical systems characteristic of vehicles and equipment using diesel engines, but it can function effectively for loads associated gasoline powered with vehicles and equipment. In addition, the system is designed for ease of handling, storage, and use.

EXAMPLE 1

Figure 1:
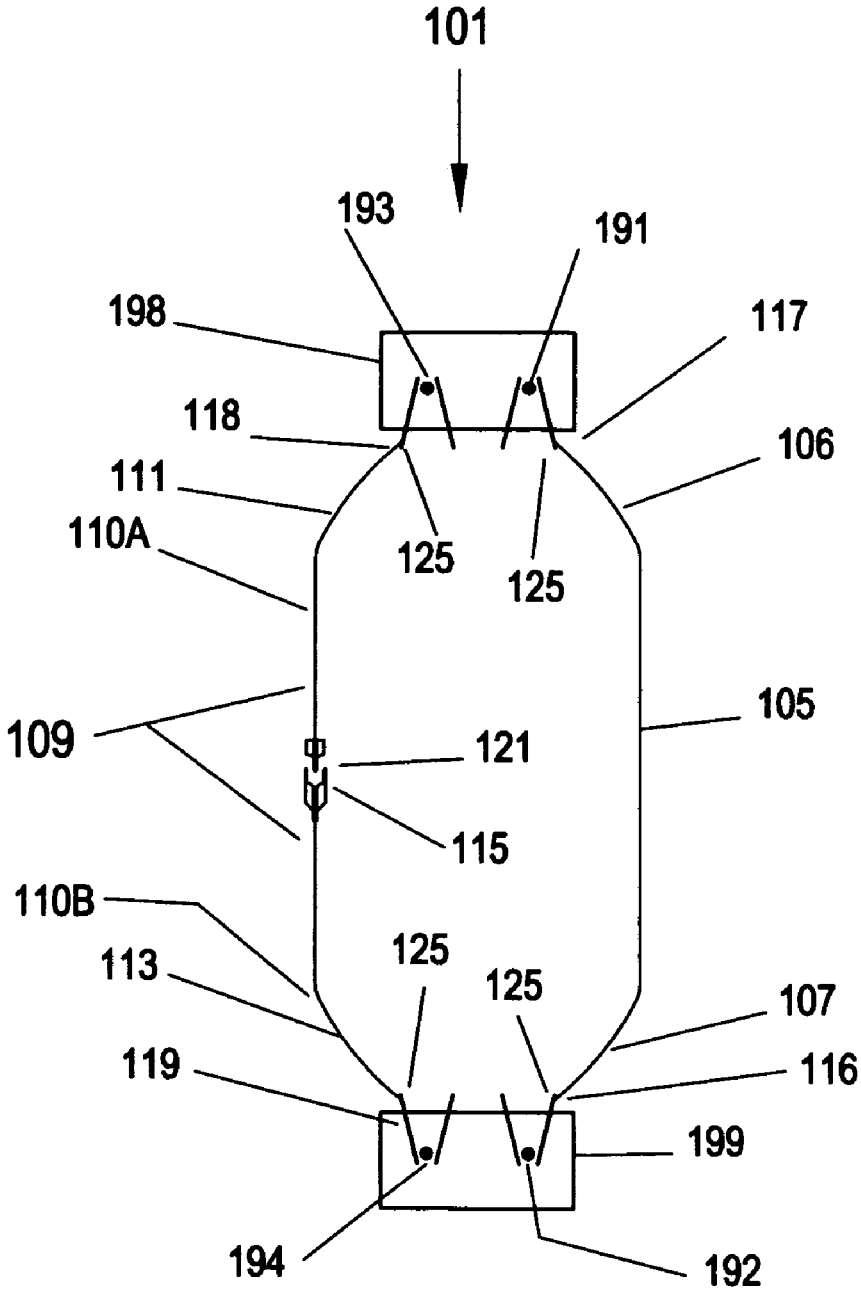
FIG. 1 illustrates the major elements of a heavy duty, jumper cable system.

The heavy duty, high efficiency jumper cable system 101 of FIG. 1 comprises a positive cable 105, and a negative cable 109. The negative cable 109 comprises two segments and is divided at its approximate midpoint 115 into a first segment 110A and a second segment 110B. The two segments 110A and 110B are physically and electrically connected by means of spark guard coupling device 121. The ends of both the positive cable 105 and of the negative cable 109 may be reversed without affecting the scope or function of the invention. Thus, the ends of the positive cable may be identified arbitrarily as the charged source or supply end 106 and the opposite end 107 as the discharge or demand end, and similarly, the ends of the negative cable 109 may be identified as the charge source or supply end 111 and discharge or demand end 113. As one of ordinary skill in the art understand, electrical current flows from the charge source end 106 to the discharge source end 107 of the cable. A cable/terminal connector device 125 is electrically and mechanically connected to each end of the positive cable 105 and the negative cable 109. Thus, the heavy duty, high efficiency jumper cable system comprises a positive cable 105 with a cable/terminal connector 125 connected to the charged source end 117 and the discharge end 116, and a negative cable 109 with a cable/terminal connector 125 electrically connected to the charged source end 118 and one connected to the discharge end 119. The positive cable 105 and the negative cable 109 both are 2/0 gauge woven wire cable, preferably copper cable.

The system includes a carrying/storage and supply case not illustrated in FIG. 1. The case protects the jumper cables and connectors, provides space for storage of tools that may be helpful in the use of the system, and may provide a simple reel system to rewind the cables after use. For marine applications, the invention anticipates that the case may include flotation capabilities.

Both the positive cable 105 and the negative cable 109 are insulated 2/0 gauge welding cable (multiple stranded copper wire encased in protective insulation). One of ordinary skill in the art recognizes that wire of this size will conduct current of 250 to 3,800 amps at 12 to 48 volts for periods of from 30 seconds to six minutes or more or more without excessive heating and loss of power transmission efficiency as well as damage from heating. The cables 105 and 109 are of equal, but variable lengths for different pairs of cables. A practical minimum length for illustrative purposes, not by way of limitation is 10 feet (3 meters). Maximum length is practically limited to 50 feet (15 meters), but this is not a fixed limitation. Average length of cables is generally 20 to 25 feet (8 meters).

The heavy duty, high efficiency jumper cable system 101 conveys electrical energy from a charged source (such as a charged battery) 198 to a discharge source (such as a discharged battery) 199. In practice, when the jumper cables are attached to the batteries, for safety, a specific sequence is suggested, starting with the spark guard coupling device 121 open so that a circuit cannot be completed through the negative cable joining the charged battery with the discharged battery. In sequence, a cable/terminal connector 125 is clamped to the positive terminal 191 of the charged source 198. Next, a second terminal/cable connector 125 is similarly connected to the positive terminal 192 of the discharge source 199. These steps comprise connecting the positive cable 105 of the jumper cable system. Then, a third terminal/cable connector 125 connected to one end of the negative cable 109 is similarly attached to the negative terminal 193 of the charged source and fourth, the terminal/cable connector 125 attached to the opposite end of the negative cable 109 is attached to the negative terminal 194 of the discharge source. Finally to complete the circuit and allow the flow of current, the spark guard coupling device 121 is connected, or closed as further illustrated in FIG. 3.

Figure 2A:
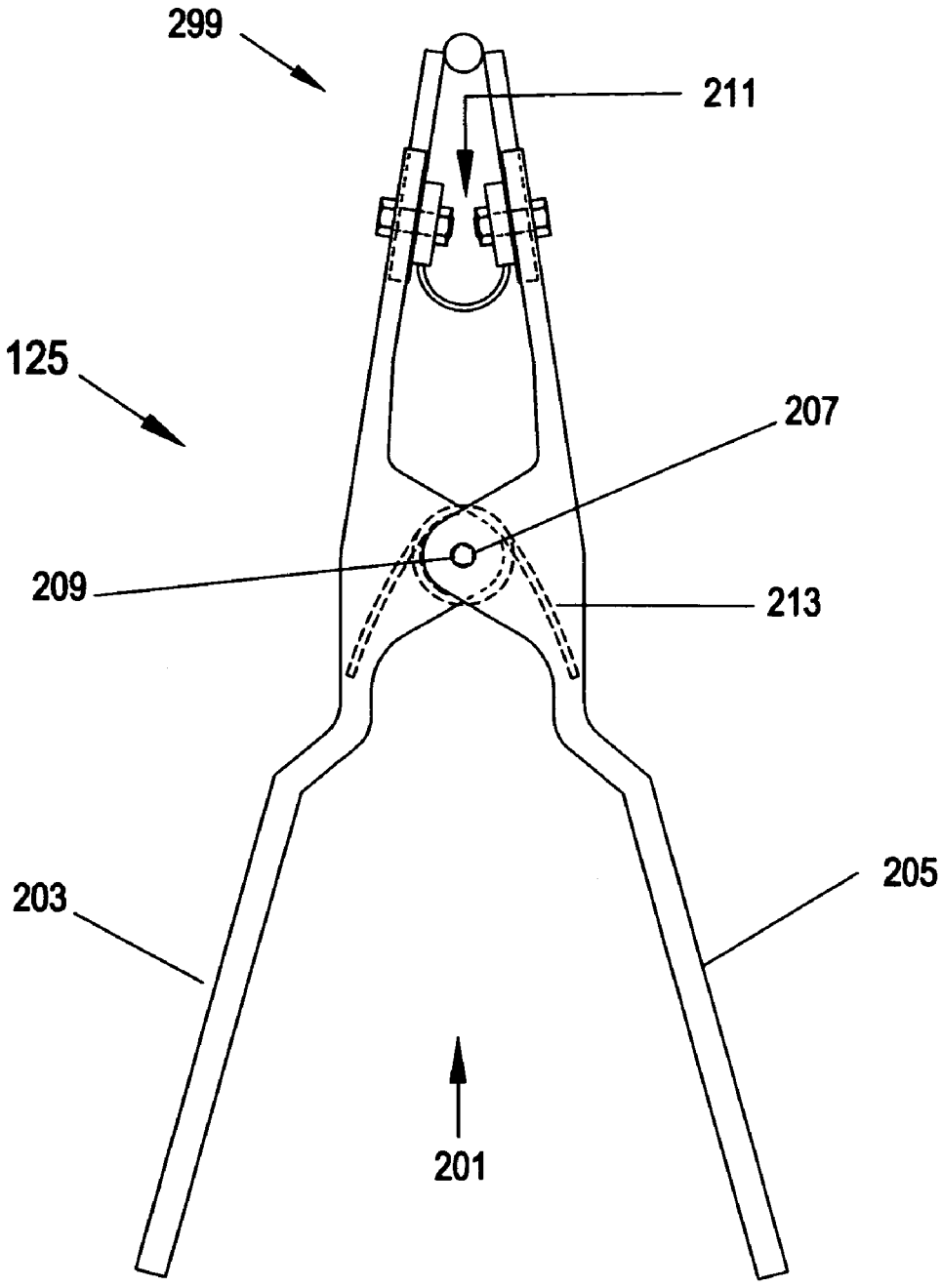
FIG. 2A is a profile view of the frame structure.

As illustrated in FIG. 2A, the terminal/cable connector 125 comprises four general parts: a frame structure 201 comprised of a first frame unit 203 and a second frame unit 205. The frame units are pivotally attached and connected by a pin-like fastener, preferably a rivet, 207 that also serves as an axle 209 and anchor point for a spring 213. The spring is the source of tension that allows the terminal/cable connectors 125 to firmly grasp the terminals of the batteries or similar structures. An electrical harness unit 211 is connected to the first frame unit 203 and the second frame unit 205 at the contact end 299 of the terminal/cable connector, and the appropriate cable (positive 105 or negative 109 of FIG. 1) is electrically connected through the grip end 216 of the first frame unit 203 to the electric harness 211, as detailed in FIG. 2E.

Figure 2B:
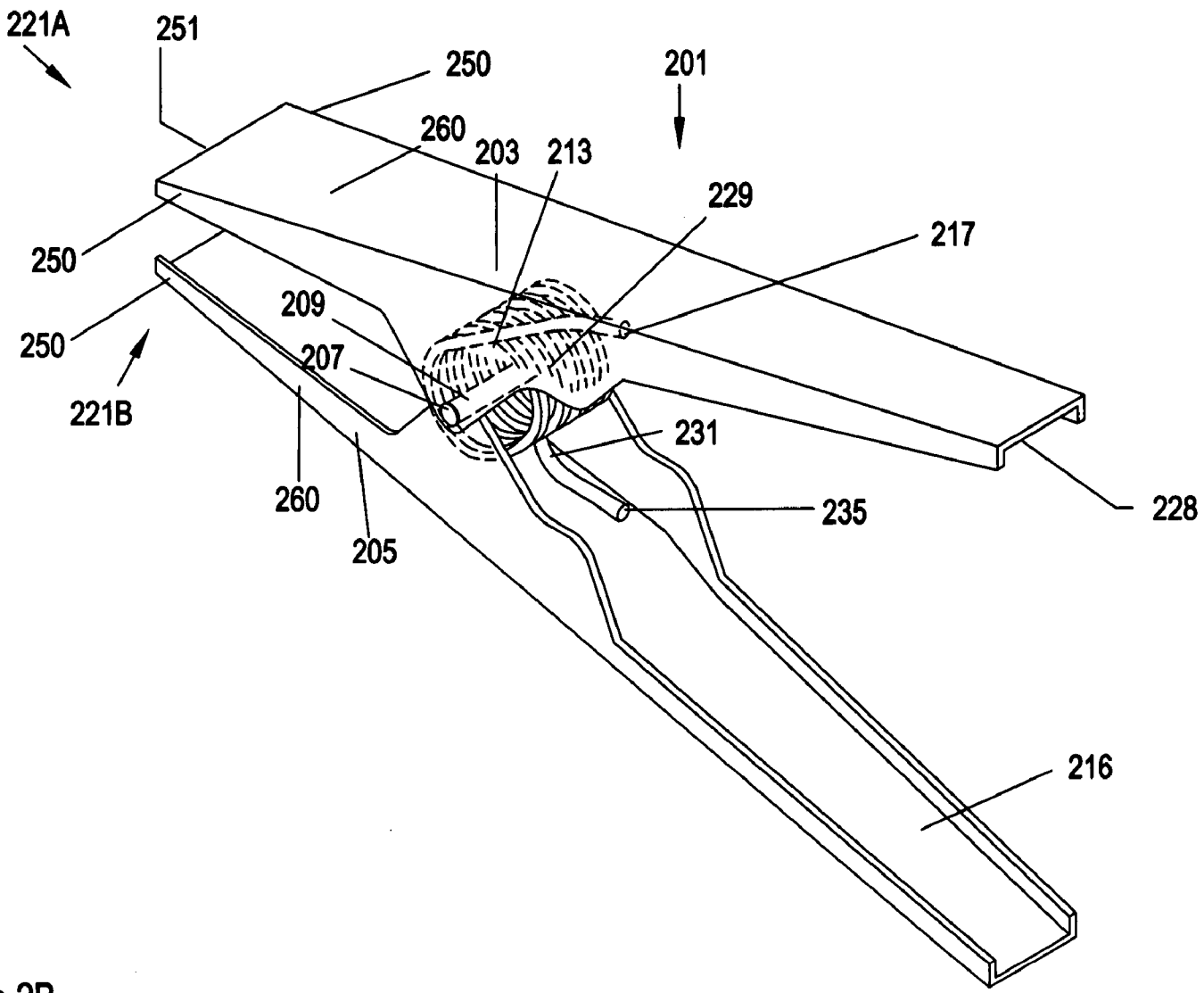
FIG. 2B is a three-dimensional, schematic view of the frame structure.

FIG. 2B illustrates the frame structure 201 and structural relationship of the first frame unit 203 and the second frame unit 205. The pivot connection by a pin-like fastener 207 that serves as an axle and the stay 209 for a spring 213 are also shown with the axle 209 passing through the longitudinal axis of the spring. The first end of the spring 229 presses against the inner surface 228 of the first frame unit 203 at a point 217 near the end 217 of the first frame unit 203, and the second end of the spring 231 presses against the inner surface 216 of the second frame unit 205 at a point 235 essentially diagonally opposite that at which the first end of the spring 229 presses against the inner surface of the first frame unit 203. The tension of the spring separates the grip ends of the first and second frame units and correspondingly causes the contact end 221A of the first frame unit and the contact end of the second frame unit 221B to be forced against each other or to firmly grip a pole or terminal positioned between them. One skilled in the art recognizes that a coil spring may be inserted between the inner surfaces of the frame units near the grip ends and at right angle to the frame units 203 and 205 as illustrated with the same effects as described and is thus anticipated by the invention.

Figure 2C:
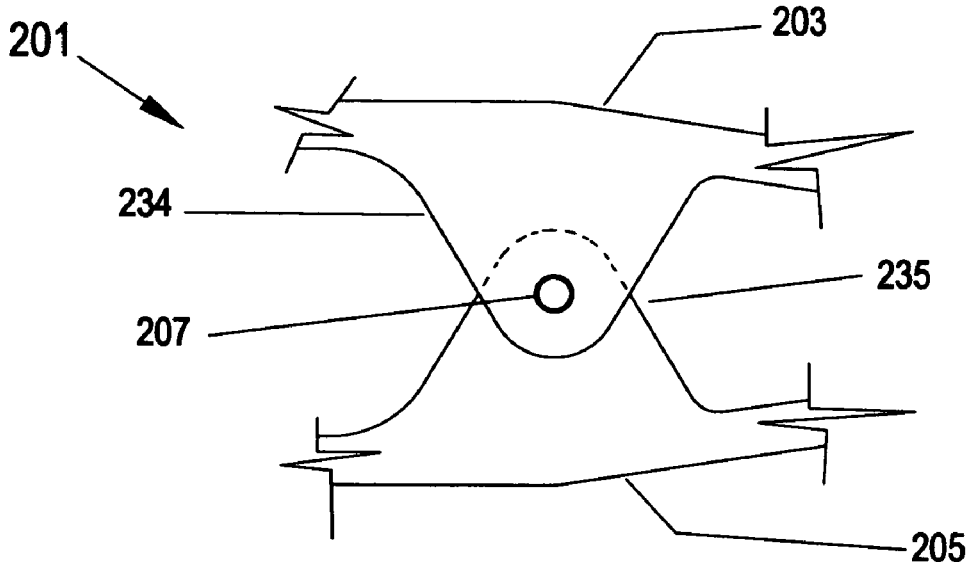
FIG. 2C is a simple profile diagram of the pivot attachment of the frame units.

FIG. 2C provides detail of one side of the first 203 and second 205 frame units. The first frame unit 203 has a pivot support 234 extending, as drawn, downward towards the center of the frame structure 201. The second frame unit 205 has a similar pivot support 235 extending, as drawn, upward towards the center of the frame structure 201. The pin-like fastener 207 connects the two frame units and extends to the second side of the frame structure as an axle (not illustrated)

and connects the second side of the frame structure as a pin-like fastener as illustrated in FIG. 2B.

Figure 2D:
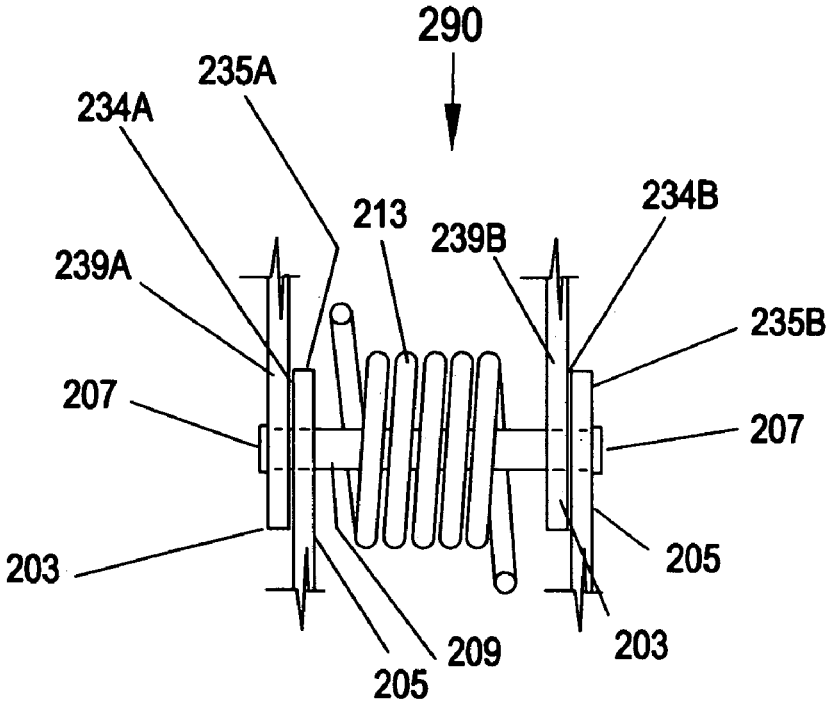
FIG. 2D is a top view diagram of the pivot attachment including the spring and axle.

FIG. 2D provides a top perspective of the pivot region 290. The first frame unit 203 has a pair of pivot supports 239A and 239B, with one member of the pair on either side of the first frame unit 203. Similarly, the second frame unit 205 has a pair of pivot supports 235A and 235B with one member of the pair on either side of the second frame unit 205. The rivet 207 extends to form an axle 209 between the two sides of the frame units, and as such, the axle 209 serves as the anchor for the spring 213. The first and second frame units are slightly offset such that the first pivot support 239A of the of the first frame unit 203 is outside of the first pivot support 235A of the second frame unit 205, and the second pivot support 239B of the first frame unit 203 is inside of the second pivot support 235B of the second frame unit 205. The degree of offset is minimal and has no practical effect on the opening and closing of the frame structure 201. Optionally, to minimize friction, a washer can be placed on the rivet between the pairs of pivot supports at points 234A and 234B.

The frame units are made from a variety of materials. Commonly, but not exclusively, they are manufactured from metal, frequently steel with a chrome finish. The frame units may be made from other metals or from plastics with adequate strength to ensure an adequately firm grasp of battery terminals as well as acceptable durability, convenience in manufacture, and cost considerations.

Figure 2E:
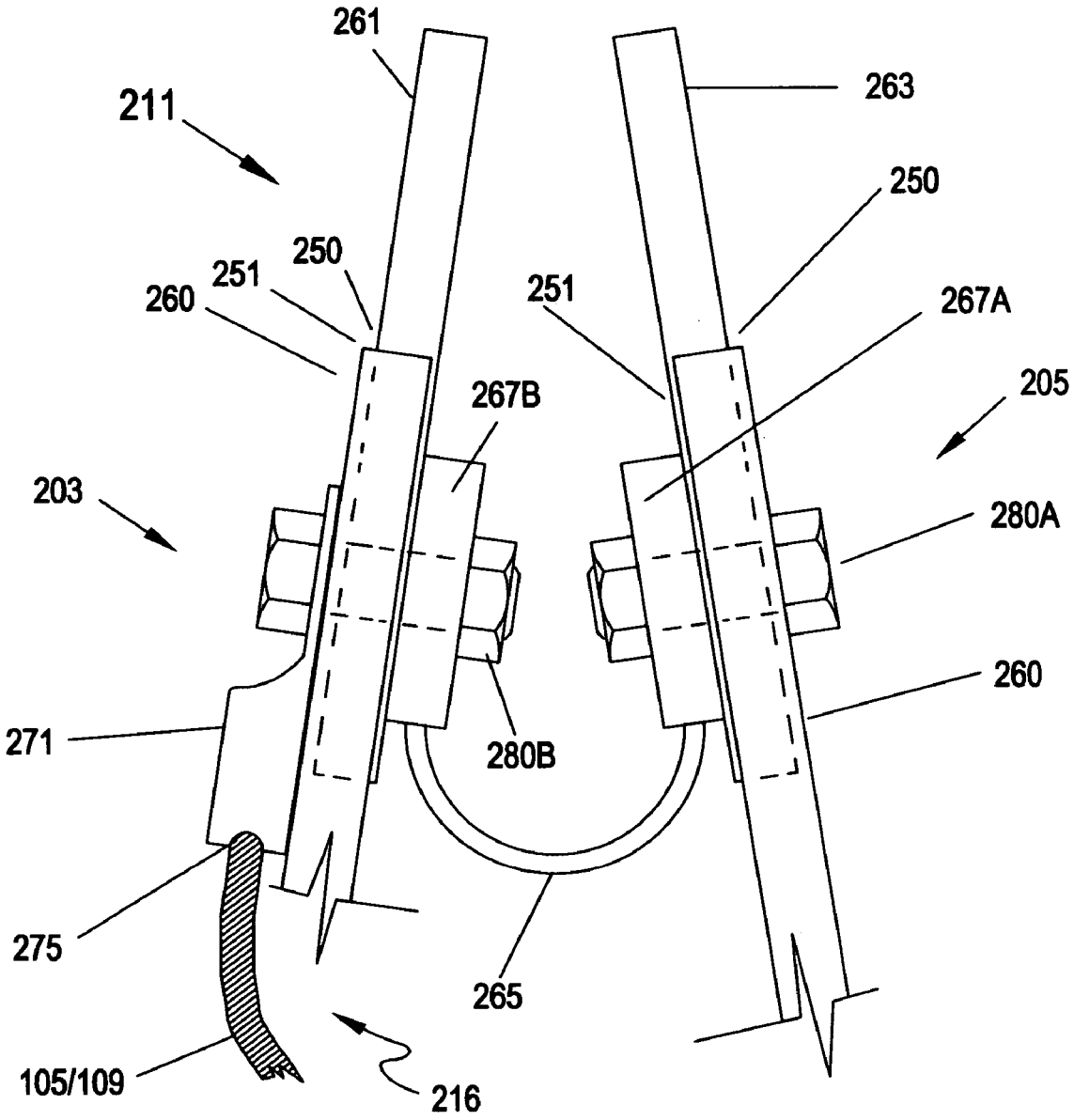
FIG. 2E is a profile view of the power harness.

As illustrated in FIG. 2B, each frame unit is manufactured from a single sheet of metal including the pivot supports and flange structures 250 shaped to form a channel 251 with the top 260 of each frame structure limiting the width of the channel, and the channel being capable of positioning the conductor unit of the power harness 211 described in FIG. 2E.

The power harness 211 as described in FIG. 2E comprises a first electrical contact 261 connected to a second electrical contact 263 by a cable 265. The connection between the first 261 and second 263 electrical contacts and the cable 265 is accomplished by conductor contact means 267A and 267B attached to the cable and connected to the electrical contacts by a fastener, preferably by a bolt and nut 280A and 280B. The fasteners are made of electrically conductive material.

As illustrated by FIG. 2E, the first conductor contact lug 271 is attached to one end 275 of one of the cables 105 or 109. The first electric contact 261 is positioned in the channel 251 formed in the first frame structure 203 by the flanges 250 and top 260 and secured to the first lug 271, first electrical contact 261, and to the second conductor contact means 267B that is attached to cable 265 by fastener 280B, preferably a bolt and nut. The second electrical contact element 263 is similarly positioned in the channel of the second frame unit 205 in the channel 251 formed by the flanges 250 and top 260. The third conductor contact means 267A is attached to cable 265 and to the second electrical contact by a fastener 280A.

The cable 265 is 1/0 stranded cable, preferably copper, conductor contact means 267A and 267B are attached to opposite ends of the cable 265. The second electrical contact 263 is positioned in the channel formed by the flanges 250 and top 260 of the second frame unit 205 and attached to third conductor contact means and second frame unit by a fastener 280A, preferably a nut and bolt, thereby forming an efficient electrical connection between the cable 265 and the second electrical contact 263.

As illustrated in FIG. 2E, the first conductor contact means 271 is attached 275 to either end of either the positive cable 105 or the negative cable 109. The first electric contact 261 is positioned in the channel 251 formed by the flanges 250 and top 260 of the first frame unit and secured to the first lug 271, first electrical contact 261, and second conductor contact means 267B are connected by a fastener, preferably a nut and bolt, that connects the conductor contact means 271 and 267B and first electrical contact 261 to the first frame unit.

With the electric harness 211 positioned in the two frame units, the two units are pivotally connected as illustrated in FIGS. 2B, C, and D. The spring 213 is positioned over the axle 209 formed by the pin-like fastener such than ends of the spring contact the inner surface of the grip portion of each support unit and spring tension forces the opposing sides of the grip portion apart and correspondingly forces the opposite end together, thereby providing the force to allow the electrical contacts to grip a terminal of a battery or similar structures.

The electrical contact elements 261 and 263 are electrical conductors of dimensions adequate to conduct efficiently the full current delivered from the charged source. The width of the electrical contacts is effectively the same as the width of the channels 251 formed in the support frames. To insure contact with a battery terminal, the depth (thickness) of the electrical contact element is greater than the depth of the channel as fixed by the flanges 250 in the first and second frame units. By way of example, but not limitation, an electrical contact element formed from copper bars 0.75 (w)×5.00 (l)×0.25 (d) inches (1.8×14.0×0.6 cm) are effective for use in the range of power anticipated herein.

Figure 3:
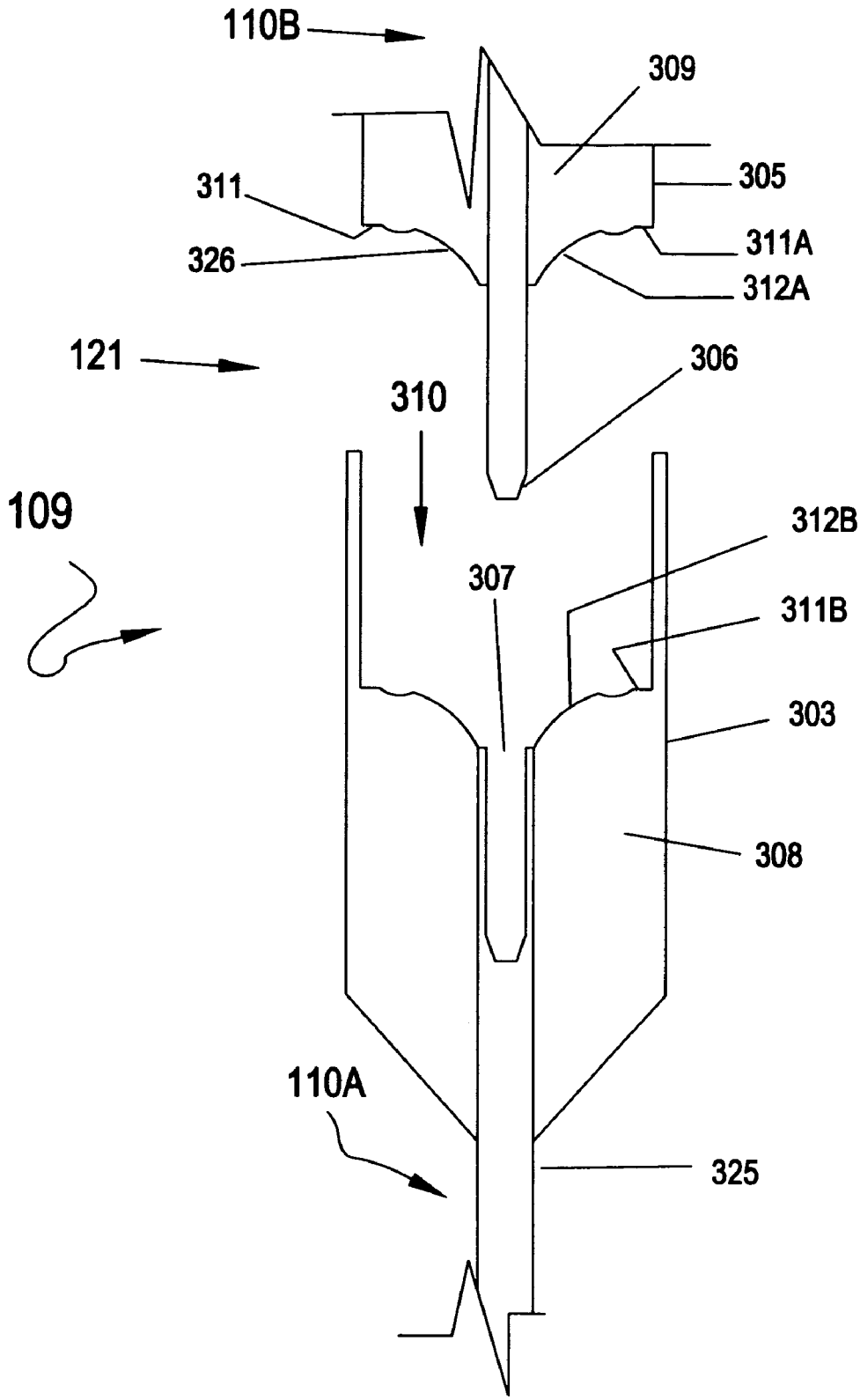
FIG. 3 is a profile diagram of the spark protection coupling means.

As illustrated in FIG. 3, closing the spark guard coupling device 121 by mechanically connecting the two segments 110A and 110B of the negative cable 109 completes the circuit. The spark guard coupling device 121 comprises two elements, the female element 303 connected to the distal end 325 of the first segment 110A of the negative cable 109, and the male element 305 connected to the distal end 326 of the second segment 110B of the negative cable 109. The female element comprises an insulated case 308 in which is positioned the receptacle 307 for the male contact 306. The male contact 306 is encased in insulation material 309 shaped to fit into the chamber 310 of the female element such that when electrical contact is made a first face 311A and second face 312A of the male element approach corresponding faces 311B and 312B in the female element and physically block discharge of any spark resulting from insertion of male contact 306 into female receptacle 307.

The benefits of the spark shield aspect of the spark guard coupling device 121 is realized only when the device is left open while the positive cable 105 is connected to the positive terminals of the charged and discharged source, and then the first segment 110A of the negative cable 109 is connected to the negative terminal of the charged source and the second segment 110B of the negative cable 109 is connected to the negative terminal of the discharge source, before the segments are coupled by insertion of the male contact into the female receptacle.

Unlike other jumper cable systems, the system of the present invention is designed to deliver high amperage loads, between about 250 and 3,800 amps at preferably 12 to 48 volts. Loss from the charge source through the system to the discharge source is minimized because the flow of current is directly to the two copper electrical contacts 261 and 263 at both the charge and discharged source ends with flow directed to the contacts by the connector cable. The connection between the contacts and supply cable established by the structure and function of the electrical harness minimizes conduction through other parts of the frame, resultant heating due to resistance or reduced conductivity, and ultimately lowered efficiency as a result of power lost to heat, as well as damage to electrical components as a result of heating damage.

Figure 4:
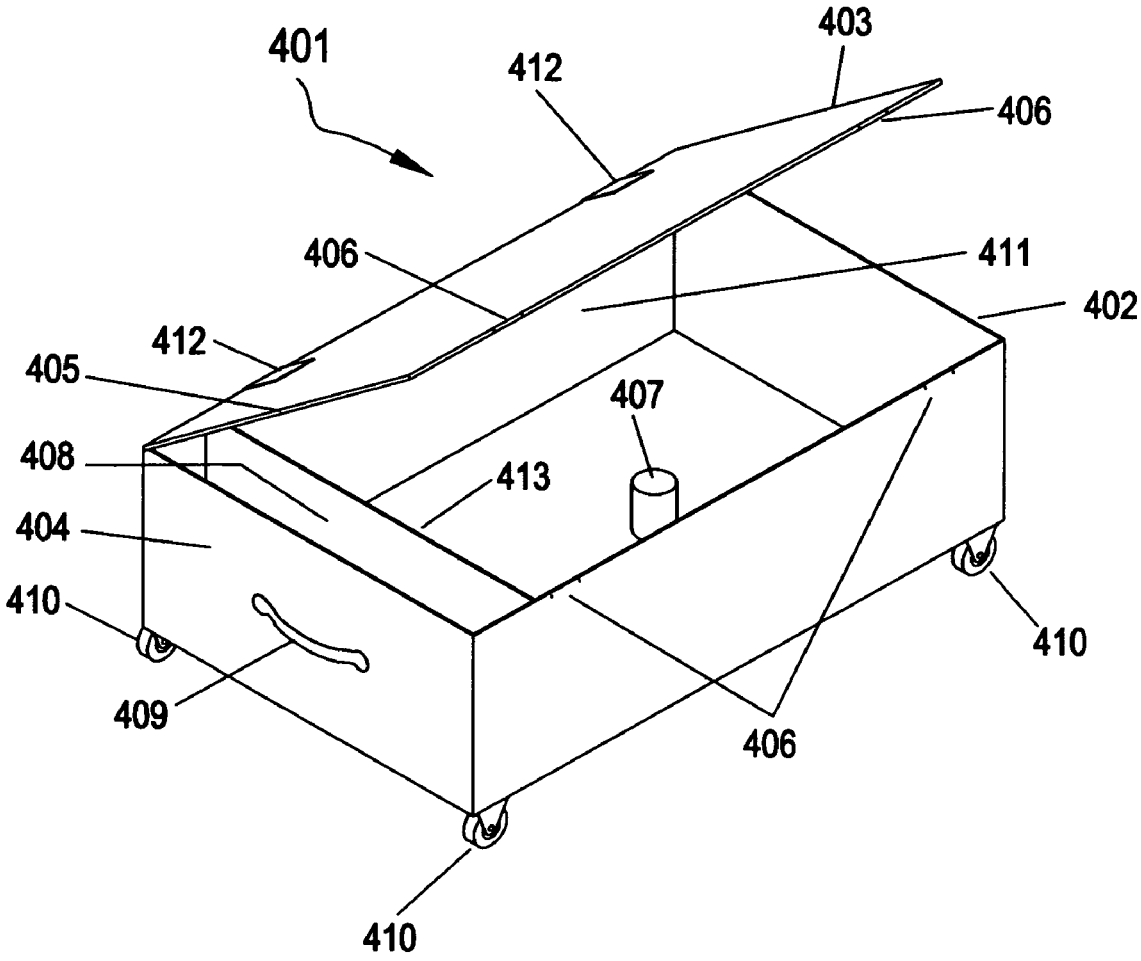
FIG. 4 is a diagram of one example of a carrying case for the jumper cable system.

The carrying case is an integral part of the invention. FIG. 4 illustrates a carrying case 401 with a variety of features. The basic case 401 comprises a box 402 and a lid 403. The lid 403 is connected to the box 401 along the rear edge 411 by hinges 412 positioned such that when the lid is closed, the edge of the lid 405 contacts the edge of the box 404 and forms a tight seal between the edges. A rubber gasket (not illustrated) may be placed around the ledge of the lid 405 and edge of the box 404 to form a secure seal. Latches 406 secure the lid 405 and box 404 in the closed position. A divider wall 413 separates a storage compartment from the interior of the box in which the cable system is stored. The dimension of the storage compartment is not critical; it is adequate to store common tools and equipment used in association with the jumper cables. A device on which to wind or gather the two cables is positioned in the approximate center of the box. This device may be a fixed post, or a reel type mechanism with a crank and spool. The case is equipped with carrying handles 409, most commonly positioned on each end of the box. Casters 410 may be positioned on the bottom corners of the box. The dimensions of the case vary and are generally determined by the length of the cables to be stored. For cables approximately 20 feet (6 meters) in length dimension of approximately 1.5 feet (l)×1.0 feet (w)×0.7 feet (d) (45.7 cm×2.5 cm×21.3 cm) are suitable. Most commonly, but not exclusively, the case is manufactured from a sturdy plastic material, similar to materials used in luggage.

EXAMPLE 2

Figure 5:
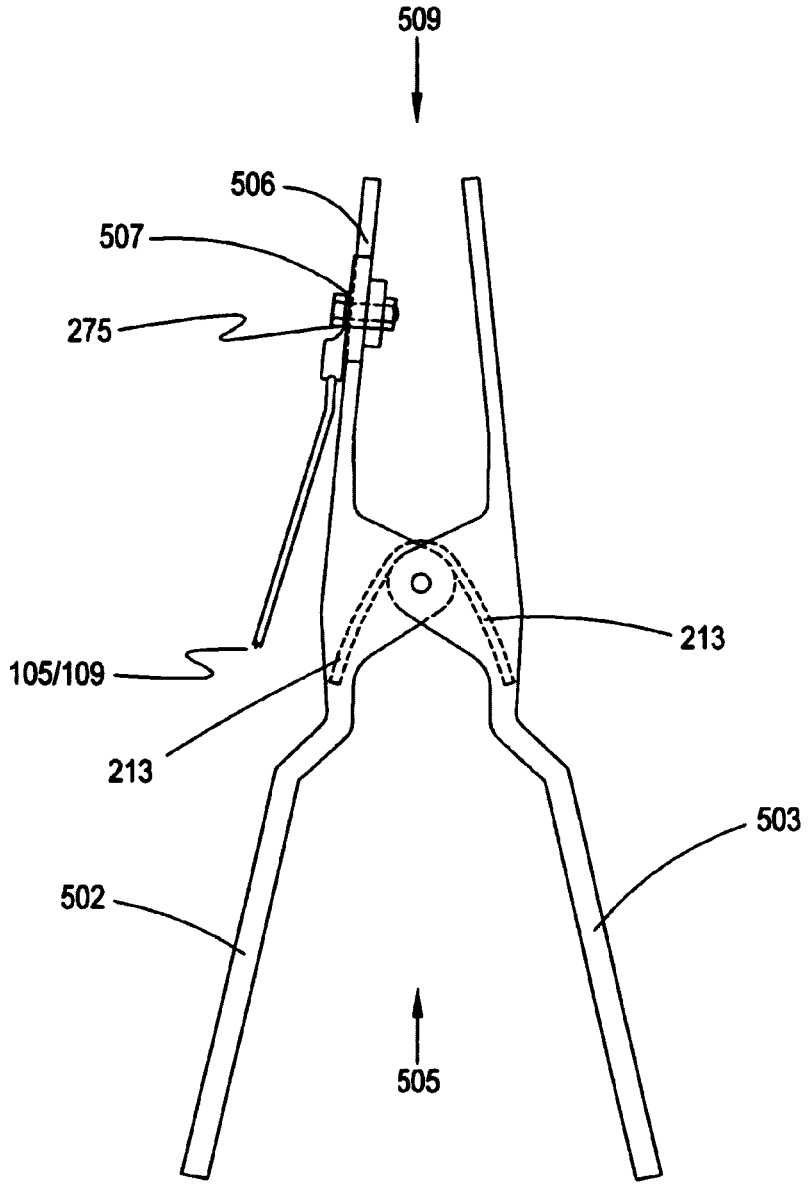
FIG. 5 illustrates an alternative configuration for the frame structure.

FIG. 5 illustrates a profile view of an alternative to the frame structure of Example 1. The frame structure comprises a first frame unit 502 and a second frame unit 503. As described in detail in Example 1, the first 502 and second 503 frame units are pivotally attached by pivot supports shown generally at 505. As in Example 1, a pin-like fastener connects the frame units and serves as an axle and anchor for the spring 213. One end of either the positive cable 105 or negative cable 109 is attached 275 to a conductor connection means 507 by a fastener, preferably a bolt and nut that also attaches electrical contact element 506 to the contact end 509 of the first frame unit 502. The fastener is a conductor that carries electrical current from the conductor connection means to the electrical contact element. The first frame unit commonly is manufactured from a metal conductor material; thus current also may pass from the conductor contact means, through the end of the first frame unit to the electrical contact element. The electrical contact element is positioned in the first frame unit as described in Example 1, and dimensions of the channel-and electrical contact element are comparable for this Example. The second frame unit 503 is manufactured from non-conductor material. The role of the second frame unit is exclusively in serving with the first frame unit to grasp the terminal of a battery.

Preferred embodiments of the invention have been described using specific terms, devices, and dimensions. The specific terms, devices, devices and dimensions are for illustrative purposes only, not as limitations. It is to be understood that changes and variations may be made by those of ordinary skill in the art without departing from the spirit or scope of the invention which is set forth in the following claims. It should be understood that aspects of various embodiments may be interchanged in whole or in part. Thus, the spirit and scope of the appended claims should not be limited to the descriptions and examples herein.

What I claim is:

1. A cable/terminal connector comprising:

a. a frame structure comprised of a first frame unit and a second frame unit, said first frame unit and said second frame units being pivotally connected by a pin-like fastener that extends between said first frame unit and said second frame unit to form an axle and anchor for a spring positioned to exert pressure to allow said first frame unit and said second frame unit to jointly grasp and establish an electrical contact with an electric terminal, and further, said first frame unit and said second frame unit being adapted to allow an electrical harness to be positioned in channels in each of said first frame unit and said second frame unit; and b. said electrical harness comprising a first electric contact element and a second electric contact element, said first electric contact element and said second electric contact element being connected by a cable attached to said first electric contact and said second electric contact by conductor connector means, a harness being in contact with one member of the pair of cables consisting of said negative cable and said positive cable by means of a conductor connection means connected by a fastener to said first support unit, and further said first electric contact and said second electric contact being positioned in a channel in each of said first and said second frame units.

2. The cable/terminal connector of claim 1 wherein said pin-like fastener is a rivet.

3. The cable/terminal connector means of claim 1 wherein said conductive connection means is a lug, and further wherein said first electrical contact and said second electrical contact are copper bars.

4. A single contact cable/terminal connector comprising:

a. a frame structure comprising of a first frame unit and a second frame unit, said first frame unit and said second frame unit being pivotally connected by a pin-like fastener that extends between said first frame unit and said second frame unit to form an axle and an anchor for a spring positioned to exert pressure to allow said first frame unit and said second frame unit to jointly grasp an electrical terminal, said first frame unit further being adapted with a channel to receive an electric contact;

b. said electric contact comprising a electrical contact element, said electrical contact element being connected by a conductor connection means to an end of one member of a pair of cable consisting of said positive cable and said negative cable, and said electrical contact element further being connected with said conductor connection means to said first support and positioned in the channel formed in said first support unit and held securely in place and in contact with said conductor connection means by a fastener;

c. said first frame is manufactured from conductive material, such as metal, and said second frame unit is manufactured from a sturdy, non-conductive material such as a plastic.

* * * * *